United States Patent [19]

Eder

[11] Patent Number: 4,514,951

[45] Date of Patent: May 7, 1985

[54] GUARD GRID FOR A PASSAGEWAY

[75] Inventor: Helmut Eder, Triesen, Liechtenstein

[73] Assignee: Multisafe AG, Schaan, Liechtenstein

[21] Appl. No.: 511,668

[22] Filed: Jul. 7, 1983

[30] Foreign Application Priority Data

Jul. 9, 1982 [CH] Switzerland ..... 4184/82

[51] Int. Cl.[3] ..... F24F 13/00

[52] U.S. Cl. ..... 52/660; 52/302; 52/204; 98/32

[58] Field of Search ..... 52/664, 660, 662, 663, 52/204, 302; 98/42, 37, 32; 109/1 S

*Primary Examiner*—John E. Murtagh
*Assistant Examiner*—Kathryn Ford
*Attorney, Agent, or Firm*—Toren, McGeady, Stanger Goldberg & Kiel

[57] ABSTRACT

A guard grid is used as protection in a ventilating shaft and similar passageways in structures with a considerable wall thickness, and the guard grid is particularly useful in nuclear power stations. In the passageway direction, the guard grid is divided into a number of grid-like members one following the other. The grid-like member on the outside of the structure has crossbars extending between opposite sides of the passageway and spacer bars extending perpendicularly to the crossbars. The crossbars and spacer bars form a honeycomb-like structure with a dimension in the direction of the passageway equal at least to the dimension of the spacer bars extending transversely of the passageway direction. An intermediate grid-like member is located next to the inner end of the outside grid-like member and it is made up of a curved framework formed of a number of parallel upwardly bent cross-members, the ends of the cross-members closer to the inside end of the passageway are spaced upwardly from the ends closer to the outside of the passageway. The curvature of the cross-members blocks the direct path of view through the passageway between the inside and the outside. The inside grid-like member is made up of a number of cross-plates with a row of spacer struts extending between each adjacent pair of cross plates. The cross plates and spacer struts form another honeycomb-like structure.

10 Claims, 3 Drawing Figures

GUARD GRID FOR A PASSAGEWAY

SUMMARY OF THE INVENTION

The present invention is directed to a guard grid for a passageway such as a ventilating shaft and similar openings, and particularly for use in structures having a considerable wall thickness. In the direction of the passageway the guard grid is made up of several different shaped grid-like members.

Such guard grids are known, note German Pat. No. 26 53 056 and Swiss Pat. No. 623,108, and they are used to close off ventilating shafts in protected structures against missiles and against unauthorized entry without causing an impermissibly high air resistance. Because of their purposes, some ventilating shafts are made up of at least two grid-like members with transversely and longitudinally extending elements which afford protection against missiles and also make unauthorized entry difficult without the use of heavy tools, however, these known guard grids are unable to resist an explosive attack.

At the present time simple guard grids are available through which a passage of air can flow, such grids prevent a direct viewing into the restricted space and do not easily permit the passage of larger objects. Such guard grids are usually made up of simple wood and/or sheet metal structures and are unable to provide any significant resistance to a forced entry. Note British Pat. No. 820,048, U.S. Pat. No. 1,517,841 and Swiss Pat. No. 473,957.

There are structures, such as in nuclear power stations or in military installations where such ventilating shafts must have a significantly stronger protection to ensure that after an attack with explosives or with the use of cutting devices, an entry is possible, if at all, only after an extended period of time, such as 30 minutes or more.

The presently available guard grids do not meet such stringent requirements and it is the primary object of the present invention to provide a guard grid which satisfies these requirements without providing an unsatisfactory increase in the resistance to air flow through the passageway.

The present invention is directed to a guard grid for passageways. This guard grid is characterized:

by an outer grid member formed of transverse bars which extend across the entire width and for the height of the passageway shaft with the bars disposed parallel to one another in spaced relation, and spacer bars disposed perpendicularly to the transverse bars with rows of such spacer bars extending between adjacent pairs of the transverse bars with the spacer bars in adjacent rows being offset, and with the combination of the transverse bars and spacer bars forming a honeycomb-like structure with a dimension in the passageway direction corresponding at least to the height of the spacer bars;

and by an intermediate member or framework following the outside grid member and made up of a number of parallel curved cross-members each of which is bent in the upward direction with the edge of each cross-member closer to the outside of the passageway positioned adjacent the edge of a transverse bar forming the outside grid member, and the rear edge of the cross-member, that is the edge more remote from the outside of the passageway is offset in the height direction of the passageway with respect to the corresponding front edge, and the cross-members have a dimension in the direction of the passageway at least twice the dimension of the transverse bars of the outside grid member in the same direction and the curvature of the cross-members prevents a direct view path through the passageway;

and an inner grid-like member following the intermediate framework and formed of a plurality of transverse plates extending across the entire width of the passageway and disposed in parallel spaced relation for the height of the passageway, and spacer struts disposed perpendicularly to the transverse plates with a row of spacer struts located between each adjacent pair of transverse plates so that the spacer struts in adjacent rows are offset, and with the combination of the plates and the struts forming a honeycomb-like structure with a dimension in the direction of the passageway which is a multiple of the dimension of the spacer struts extending transversely of the passageway direction, and the edge of each transverse plate located closer to the outside end passageway is positioned adjacent the edges of the cross-members in the intermediate framework closer to the inside end of the passageway.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
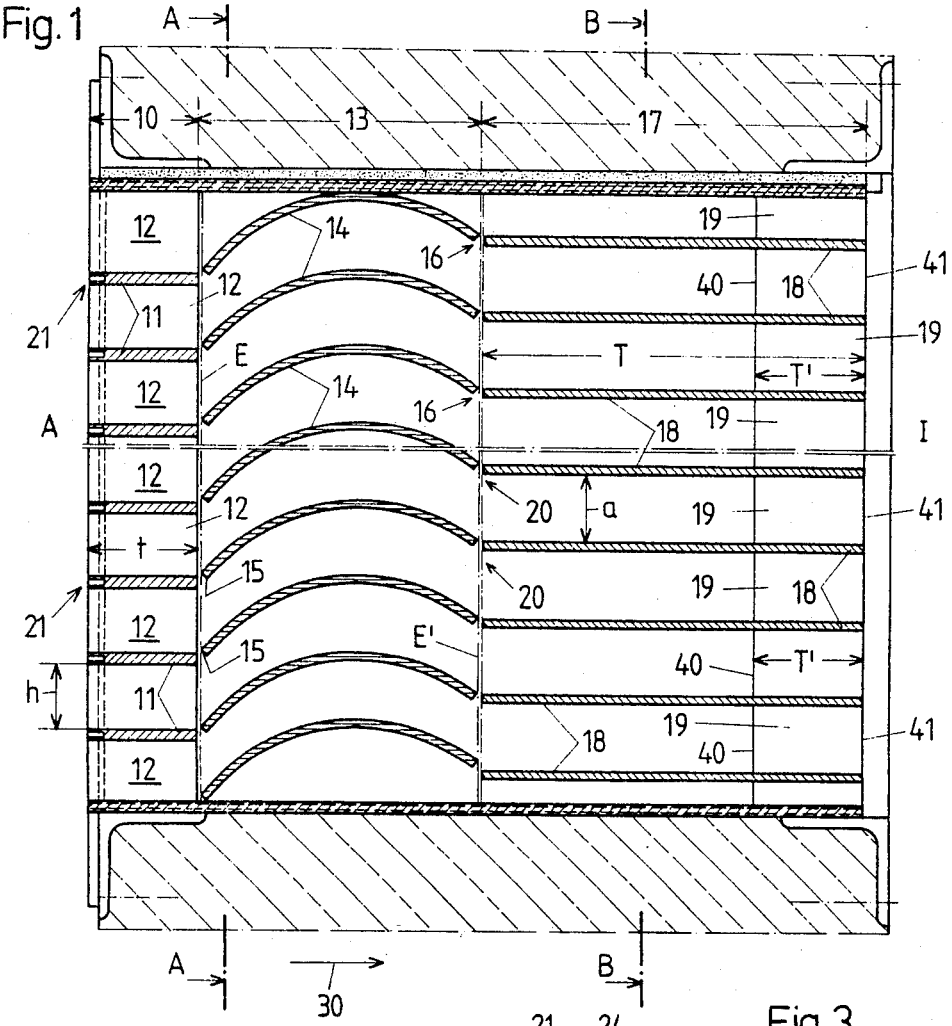
FIG. 1 is a longitudinal sectional view of a guard grid embodying the present invention positioned within a passageway acting as a ventilating shaft.

In the drawing a guard grid for a passageway is illustrated and the guard grid is made up of a series of three grid-like members or structures arranged one following the other in the passageway direction, note arrow 30. The passageway forms a ventilating shaft with the passageway direction from the outside to the inside being indicated by the arrow 30. As viewed in FIG. 1, A is the outside of the building and I is the inside of the building. As can be seen in the upper portion of FIG. 1, the guard grid is divided into an outside grid-like member 10 followed by an intermediate grid-like member 13 and an inside grid-like member 17.

The outside grid-like member 10 extends inwardly through the passageway from the outside A of the building. The grid-like member 10 is formed of a plurality of transverse bars 11 extending across the full width of the shaft or passageway, that is between the opposite sides of the passageway with the bars 11 disposed parallel to one another. The transverse bars are welded on both ends to the vertically extending sides 25 of a frame formed on sides 25, 26, note FIG. 2. A row of spacer bars 12 extend perpendicularly of the transverse bars 11 between each adjacent pair of the transverse bars. The spacer bars 12 in each adjacent row are offset relative to one another, note the left-hand part of FIG. 2 so that the grid-like member 10 has a honeycomb-like configuration. The depth or dimension t of the grid-like member 10, that is, the dimension in the direction of the arrow 30, corresponds at least to the height h of the individual spacer bars, however, the dimension t may also be greater than the height H. The outside view of the honeycomb-like outside grid member 10 is illustrated in the left hand part of FIG. 2.

Adjacent the inward end of the outside honeycomb-like grid member 10, in the passageway direction illustrated by the arrow 30, is a second or intermediate grid-like member in the form of a framework 13 made up of a plurality of cross-members 14 in parallel relation to one another and spaced apart in the direction transverse to the passageway direction. Each of the cross-members 14 is curved upwardly between its edge closer to the outside of the building and its edge closer to the inside of the building so that each member has a convexly curved upper surface and a concavely curved lower surface. The front edge of each cross-member 14, that is the edge closer to the outside of the building, is located adjacent the rear edge of one of the transverse bars 11 of the outside honeycomb-like grid member 10. The rear edge 16 of each of the cross members 14 is located somewhat higher than the front edge, note FIG. 1. The dimension of the intermediate grid-like member or framework 13 in the passageway direction is at least twice as great as the dimension of the outside honeycomb-like grid member 10 in the same direction. The height of the arc of curvature of each cross member 14 is selected so that it is sufficiently high to block the view through the guard grid from the outside to the inside. The air passage through the uppermost row of the grid is made difficult or is completely blocked by the uppermost curved cross-member 14, note FIG. 1. From practical experience and from measurements taken, however, it has been established that the flow resistance through the entire guard grid is only increased to an insignificant amount. In FIG. 2 the center portion represents a cross-section taken along line A—A through the guard grid, note FIG. 1 and it can be noted that the rear edge 16 of each cross-member 14 is offset with respect to the corresponding front edge 15 of the same cross-member by approximately half of the height H of the spacer bars 12.

Figure 3:
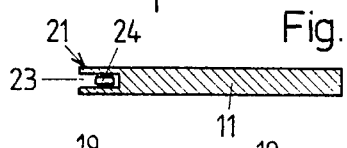
FIG. 3 is a sectional view through a transverse bar used as part of the guard grid for a passageway as shown in FIG. 1.

In the passageway through the building, a third grid-like member 17 follows the framework 13 and it is made up of transverse plates 18 disposed parallel to one another and extending across the entire width of the passageway, that is, these transverse plates 18 extend in the same direction as the transverse bars 11. The transverse plates 18 have a dimension T in the direction of the passageway which is a multiple of the space a between adjacent parallel transverse plates 18. Spacer struts 19 extend vertically between adjacent parallel transverse plates 18. There is a row of spacer struts 19 between each adjacent pair of transverse plates 18. The spacer struts 19 in adjacent rows are offset relative to one another, note the right-hand part of FIG. 3. Due to the arrangement of the transverse plates 18 and the spacer struts 19, the inside grid has a honeycomb-like structure. The dimension T′ of the spacer struts 19 in the direction of the passageway is considerably less than the corresponding dimension of the transverse plates 18. The dimension T of the transverse plates 18 is a multiple of the dimension T′ of the spacer struts 19, and the spacer struts are located relative to the transverse plates 18 so that the edges of the struts spaced from the inside of the building are spaced at a considerable distance from the end of the framework 13 adjacent to the inside end of the inside grid-like member 17. The edge of the spacer struts 19 located at the inside of the building are in the plane of the inside end of the inside grid member 17. The height of the spacer struts 19 corresponds to the height h of the spacer bars 12 of the outside grid-like member 10 so that the inside and outside grid-like members 10, 17 have the same number of horizontally extending bars or plates. This is an important feature because the inside grid-like member 17 is arranged in the passageway or ventilating shaft in such a way that the edge of each of the transverse plates 18 closer to the outside of the passageway is located at a rear edge 16 of the curved cross-members 14, note FIG. 1. Therefore, the spacer struts 19 above the uppermost transverse plate 18 and below the lowermost transverse plate 18 have a smaller height than the spacer struts between the other transverse plates 18.

Figure 2:
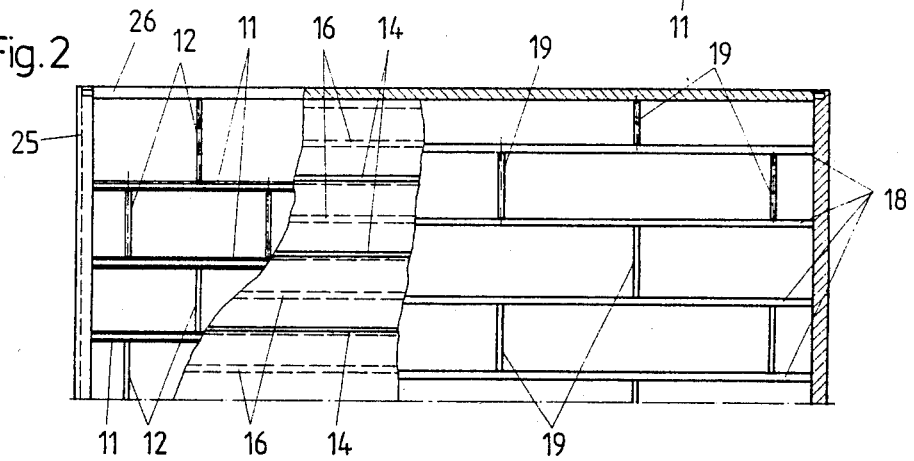
FIG. 2 is a view, partly in section, taken, in part, along line A—A in FIG. 1 and another section taken along line B—B, also in FIG. 1.

With the guard grid for a passageway through a building as illustrated in FIGS. 1 and 2, the passageway, forming a ventilating shaft which is to be protected, is divided into a plurality of horizontal individual shafts all of which, with the exception of the uppermost part of the shaft, have an unimpeded air flow passage though the path of view from the outside to the inside through the guard grid is blocked by the intermediate grid-like member 13. Experience with and practical tests performed on the guard grid embodying the present invention have shown that the curved grid-like framework 13 located downstream from the outside honeycomb-like grid member 10 affords a surprisingly effective protection against attacks with explosives. It has been proven that the pressure waves which originate from an explosion on the outside of the building in front of the outside grid-like member 10 only deform the curved cross-members 14 but do not tear or rupture them. Such deformation results in a completely irregular dislocation of the individual cross-members 14 and in a practically complete blockage of the ventilating shaft so that a passage opening through the shaft can only be effected with cutting tools and a large amount of time.

In the illustrated embodiment of the guard grid shown in FIGS. 1 and 2 and described above, the spacer struts 19 have a dimension T′ in the passageway direction which is considerably less than the corresponding dimension T of the transverse plates 18. As a result, the spacer struts 19 are located in the inner region of the passageway opening so that there edges spaced from the inside of the building or closer to the framework 13 are located a considerable distance from the framework. Therefore, the transverse plates 18 extend self-supported from the spacer struts 19 to the rear edges 16 of the curved cross-members 14, that is the edges closer to the inside of the building. This embodiment of the inside grid-like member 17 has proved to be particularly effective in explosion tests because the self-supporting parts of the transverse plates 18 are easily deformed and make any entry through the ventilating shafts difficult. Depending on the purpose for which the guard grid is provided, there is the possibility in constructing the guard grid to increase or decrease the dimension of the grid-like members 10, 13 and 17 in the passageway direction desired.

It is often desired in the guard grid such as is embodied in the present invention, to provide a surveillance system so that any attempt to gain passage through the grid releases a warning signal. To provide such a signal, the individual cross or transverse bars 11 can be provided along the outside edge 21 or along the inside edge with a groove 23 as shown schematically in FIG. 3. A suitable electrical, pneumatic or hydraulic signal line can then be embedded in the groove 23 and connected to the surveillance system of a known construction. Since such surveillance systems are known, a further detailed description of such a system is unnecessary.

As a modification of the illustrated embodiment, it is possible to arrange the transverse or cross bars 11 which extend across the width of the shaft and face the outside A of the building, so that they are inclined downwardly toward the outside whereby any rain water which enters the passageway opening can be directed to the outside.

In the embodiment illustrated in FIG. 1, the cross-members 14 are curved so that they provide a groove-like appearance in the downward direction. It is also possible within the scope of the invention, to shape the cross-members so that they are V-shaped or trapezoidally shaped in cross-section. While such different shapes are effective they tend to cause a slight increase in the air passage resistance.

In the separating plane E between the adjacent ends of the outside grid-like member 10 and the intermediate grid-like member or framework 13 and/or in a separating plane E' between the adjacent ends of the intermediate grid-like member or framework 13 and the inside grid-like member 17, it is advantageous to provide a vertical mesh grating extending perpendicularly to the plane of FIG. 1. The mesh width of the mesh grid is approximately 15 to 20 mm. Such a mesh grid not only prevents birds and other animals from passing through the guard grid, it also prevents any insertion and passage through the guard grid of a hose through which it would be possible to direct a liquid explosive.

While specific embodiments of the invention have been shown and described in detail to illustrate the application of the inventive principles, it will be understood that the invention may be embodied otherwise without departing from such principles.

I claim:

1. A guard grid for use in a ventilating shaft and similar passageway, such as in structures with a considerable wall thickness, said guard grid comprising a plurality of different grid-like members provided one following the other in the direction of the passageway through a wall, said guard grid having a first end and a second end spaced apart in the direction of the passageway and a pair of first sides extending between the first and second end spaced apart in the direction extending transversely of the first end-second end direction and a pair of second sides extending between the first and second ends and spaced apart transversely of the first end-second end direction and extending transversely of the first sides, a first grid-like member extending from the first end toward the second end of said guard grid, a second grid-like member extending from the second end toward the first end of said guard-grid and an intermediate grid-like member extending in the first end-second end direction and located between said first and second grid-like members, said guard grid having a first and a second direction each extending transversely of the first end-second end direction with said first and second directions extending substantially perpendicularly of one another, said first grid-like member comprising a plurality of first bars extending in the first direction between the first sides of said guard grid and disposed in spaced parallel relation and a plurality of first spacer bars arranged substantially perpendicularly to and extending between adjacent said first bars so that a row of said first spacer bars are located between adjacent pairs of said first bars, and said first spacer bars in adjacent said rows being offset, said first bars and first spacer bars form a honeycomb-like structure with the dimension in the first end-second end direction equal at least to the dimension of said first spacer bars extending in the direction between the second sides of said guard grid, said intermediate grid-like member including a plurality of cross-members disposed in spaced parallel relation extending between the first sides of said guard grid and said cross-members being bent in the plane extending in the first end-second end direction and in the direction between the second sides of said guard grid so that each of said cross-members has a first surface facing toward one of said second sides and a second surface facing toward the other of said second sides, each said cross member has a first edge and a second edge spaced from the first edge in the first end-second end direction and said first edge is located adjacent to the edges of said bars of said first grid-like member more remote from the first end of said guard grid, said second edge of each said cross-members is offset relative to the first edge of the same said cross-member in the direction between the second sides of said guard grid, and the dimension of said cross-member in the first end-second end direction is at least twice the dimension of said first bars extending in the first and second end direction, and said second grid-like member comprising a plurality of plates disposed in spaced parallel relation and extending between the first sides of said guard grid and in the first end-second end direction, a plurality of spacer struts each arranged perpendicularly to a pair of adjacent said plates extending in the first end-second end direction with a row of said spacer struts located between each pair of adjacent said plates, said spacer struts in adjacent said rows thereof being offset, said plates and spacer struts forming a honeycomb-like structure with the dimension in the first end-second end direction being a multiple dimension of said spacer struts in the direction between said second sides, and said plates having a first edge extending between said first sides of said guard grid adjacent the second edge of said cross-members.

2. A guard grid, as set forth in claim 1, wherein at least one of the edges of said first bars extending between the first sides of said guard grid is provided with a groove, and means positioned within said groove for connection to a surveillance system.

3. A guard grid, as set forth in claim 1, wherein said first bars extending between the first sides of said guard grid are inclined downwardly toward the first end of said guard grid.

4. A guard grid, as set forth in claim 1, wherein the dimension of said spacer struts in the first end-second end direction is less than the dimension of said plates extending in the first end-second end direction, and said spacer struts are located adjacent the second end of said guard grid so that the edges of said spacer struts closer to said intermediate grid-like members are spaced from the edges of said cross-members located closer to the second end of said guard grid.

5. A guard grid, as set forth in claim 4, wherein the dimension of said plates extending in the first end-second end direction is a multiple of the dimension of said spacer struts extending in the first end-second end direction.

6. A guard grid, as set forth in claim 1, wherein said first spacer bars are disposed in spaced relation and said spacer struts are disposed in spaced relation and the distance between adjacent said first spacer bars is less than the distance between adjacent said spacer struts.

7. A guard grid, as set forth in claim 1, wherein a plane of separation extending transversely of the first end-second end direction and extending between the first sides and second sides of said guard grid separates the adjacent ends of said first grid-like member and said intermediate grid-like member and a second plane of separation extending transversely of the first end-second end direction and between said first sides and said second sides of said guard grid is located between said intermediate grid-like member and said second grid-like member, and a mesh grating arranged in each of said first and second planes of separation.

8. A guard grid, as set forth in claim 7, wherein said mesh grating has a mesh opening in the range of approximately 15 to 20 mm.

9. A guard grid, as set forth in claim 1, wherein said cross-members of said intermediate grid-like member being curved and each having a concavely curved surface and a convexly curved surface with each of said cross-members first curving upwardly from the adjacent end of said first grid-like member to a location intermediate said first and second grid-like members and then curving downwardly to the adjacent end of said second grid-like member.

10. A guard grid, as set forth in claim 9, wherein the dimension in the direction between said second sides from the edges of said cross-members closer to said first grid-like member to the point of the convexly curved surface closest to the second side of said guard grid is greater than the dimension from the convexly curved surface closest to said second side to the edges of said cross-members located adjacent to said second grid-like member.

* * * * *